US009440469B2

(12) United States Patent
Zhang et al.

(10) Patent No.: US 9,440,469 B2
(45) Date of Patent: Sep. 13, 2016

(54) PAPER DISCHARGE MECHANISM, PRINTING DEVICE, AND TERMINAL EQUIPMENT

(75) Inventors: Zhengmin Zhang, Shandong (CN); Xiaojie Tang, Shandong (CN); Tianxin Jiang, Shandong (CN); Min Yang, Shandong (CN)

(73) Assignee: SHANDONG NEW BEIYANG INFORMATION TECHNOLOGY CO., LTD. (CN)

( * ) Notice: Subject to any disclaimer, the term of this patent is extended or adjusted under 35 U.S.C. 154(b) by 226 days.

(21) Appl. No.: 14/239,191

(22) PCT Filed: Aug. 8, 2012

(86) PCT No.: PCT/CN2012/079849

§ 371 (c)(1),
(2), (4) Date: Feb. 17, 2014

(87) PCT Pub. No.: WO2013/023544

PCT Pub. Date: Feb. 21, 2013

(65) Prior Publication Data

US 2014/0197268 A1 Jul. 17, 2014

(30) Foreign Application Priority Data

Aug. 18, 2011 (CN) ..... 2011 1 0237973

(51) Int. Cl.

| | |
|---|---|
| ***B65H 26/02*** | (2006.01) |
| ***B41J 29/393*** | (2006.01) |
| ***G07B 5/00*** | (2006.01) |
| ***B41J 11/00*** | (2006.01) |
| ***B41J 15/04*** | (2006.01) |
| ***B65H 29/52*** | (2006.01) |

(52) U.S. Cl.

CPC ..... *B41J 29/393* (2013.01); *B41J 11/006* (2013.01); *B41J 15/046* (2013.01); *B65H 26/02* (2013.01); *B65H 29/52* (2013.01); *G07B 5/00* (2013.01); *B65H 2301/3123* (2013.01); *B65H 2301/51212* (2013.01); *B65H 2402/443* (2013.01); *B65H 2404/6111* (2013.01); *B65H 2407/10* (2013.01); *B65H 2408/13* (2013.01); *B65H 2511/20* (2013.01); *B65H 2511/528* (2013.01); *B65H 2553/00* (2013.01); *B65H 2801/12* (2013.01)

(58) Field of Classification Search

CPC .. B65H 26/02; B65H 29/52; B65H 2408/13; B65H 2404/6111; B65H 2407/10; B65H 2511/20; B65H 2553/00; B65H 2301/3123; B65H 2801/12; B65H 2511/528; B65H 2402/443; B65H 2301/51212; B65H 2220/02; B65H 2220/03; B65H 2220/01; B65H 2220/09; B65H 2220/11; B41J 29/393; B41J 15/046; B41J 11/006; B41J 26/02; B41J 2301/3123; G07B 5/00

See application file for complete search history.

(56) References Cited

U.S. PATENT DOCUMENTS 5,931,407 A * 8/1999 Uwagaki ..... B41J 15/042 242/564.4
2003/0118357 A1* 6/2003 Fromm ..... B65H 5/062 399/21

FOREIGN PATENT DOCUMENTS

CN 201186537 1/2009
CN 201205789 3/2009

(Continued)

OTHER PUBLICATIONS

International Search Report for International Patent Application No. PCT/CN2012/079849, mailed Nov. 8, 2012.

*Primary Examiner* — William A Rivera
(74) *Attorney, Agent, or Firm* — McAndrews, Held & Malloy, Ltd.

(57) ABSTRACT

The paper discharge mechanism comprises: a first side passage plate and a second side passage plate between which an S-shaped paper conveying passage is formed, wherein the second side passage plate comprises a paper jam detection plate and a paper pullout detection plate both pivotally connected on a frame; a first elastic element biasing the paper jam detection plate and a second elastic element biasing the paper pullout detection plate; and a first sensor and a second sensor. A surface of the paper jam detection plate facing paper is concave and is held against the paper and rotates in the direction away from the first side passage plate during paper jam; a surface of the paper pullout detection plate facing the paper is convex and is held against the paper and rotates in the direction away from the first side passage plate during paper pullout.

17 Claims, 6 Drawing Sheets

(56) References Cited

FOREIGN PATENT DOCUMENTS

| | | |
|---|---|---|
| CN | 201511597 | 6/2010 |
| CN | 201592920 | 9/2010 |
| CN | 201841763 | 5/2011 |
| JP | 9-208094 | 8/1997 |
| JP | 11-21001 | 1/1999 |
| JP | 2001-335211 | 12/2001 |

* cited by examiner

PAPER DISCHARGE MECHANISM, PRINTING DEVICE, AND TERMINAL EQUIPMENT

The present application claims the priority of a Chinese invention patent application, Application Number 201110237973.3, entitled "Paper discharge mechanism, printing device and terminal equipment", filed with the State Intellectual Property Office of the P.R.C on Aug. 18, 2011, the entire disclosure of which is incorporated herein by reference.

TECHNICAL FIELD OF THE INVENTION

The present invention relates to the field of printer, and in particular to a paper discharge mechanism, and a printing device and a terminal equipment having the paper discharge mechanism.

BACKGROUND OF THE INVENTION

Self-service terminal equipments have been widely applied in various fields, and self-service terminals are generally provided with printing devices, e.g. an Automated Teller Machine (ATM) is capable of printing a transaction voucher, and a self-service telephone bill enquiry machine is capable of printing a telephone bill etc.

Currently, such self-service terminal equipments with a printing function generally have the following problem: if a user interferes with paper output during a printing process, a printing device fault may be caused, e.g. when a user blocks a paper exit and stops paper output during a printing process, paper jam and stacking are easily caused in an automatic terminal exit and can be hardly observed outside a self-service terminal equipment, thus paper is blocked between the printer paper exit and the self-service terminal paper exit, and the next printing operation cannot be performed. In addition, if a user pulls out a piece of paper being printed during a printing process, paper deflection is easily caused to result in paper jam or unused paper will be pulled out continuously to cause paper waste.

To solve the problem, Chinese Patent Publication Number CN201841763U puts forward a paper discharge mechanism and a printing device and a terminal equipment having the paper discharge mechanism. As shown in FIG. 1, the paper discharge mechanism comprises a paper jam detection mechanism 31' and a paper pullout detection mechanism 32', and a paper discharging passage is formed therebetween, wherein the paper jam detection mechanism 31' comprises a first passage plate 311', a paper containing portion 311*a*' containing a paper's bending portion on the first passage plate 311' and a paper detector 312' located on the paper containing portion 311*a*'; the paper pullout detection mechanism 32' comprises a second passage plate 321', a floating plate 322' penetrating through the second passage plate 321' and extending into the paper discharging passage, an elastic element 323' that provides elasticity for the floating plate 322' so that the floating plate 322' has the trend of extending into the paper discharging passage, and a floating plate position detector 324' located on the second passage plate 321'.

Paper used by a printing device is generally roll paper twisted on the periphery of a paper roll core, wherein paper with the inner surface as a printing side is called inside disposed paper and paper with the outer surface as a printing side is called outside disposed paper. FIG. 2*a* shows a curled state during an inside disposed paper printing process, wherein paper runs between a printing head 211 and a roller 212, and the printing head 211 is in contact with a paper printing surface P1. FIG. 2*b* shows a curled state during an outside disposed paper printing process, wherein paper runs between a printing head 211 and a roller 212 and the printing head 211 is in contact with a paper printing surface P2.

The inventors found that, when the paper as shown in FIG. 2*a* is used during a printing process, the leading end of the paper is curled toward the direction of the first passage plate 311', thus the paper is easily blocked in the paper containing portion 311*a*' of the paper jam detection mechanism to cause a printer fault of paper jam. Therefore, the paper jam mechanism is unreliable in conveyance.

SUMMARY OF THE INVENTION

The purpose of the present invention is to provide a paper discharge mechanism capable of preventing a user from interfering with paper output and also enhancing the reliability of paper conveyance, a printing device and a terminal equipment having the paper discharge mechanism.

Therefore, the present invention provides a paper discharge mechanism, comprising: a first side passage plate and a second side passage plate, between which an S-shaped paper conveying passage is formed, wherein the second side passage plate comprises a paper jam detection plate and a paper pullout detection plate both pivotally connected on a frame; a first elastic element biasing the paper jam detection plate toward the first side passage plate and a second elastic element biasing the paper pullout detection plate toward the first side passage plate; and a first sensor for detecting the position of the paper jam detection plate and a second sensor for detecting the position of the paper pullout detection plate, wherein a surface of the paper jam detection plate facing paper is concave and is held against the paper and rotates in the direction away from the first side passage plate during paper jam; a surface of the paper pullout detection plate facing the paper is convex and is held against the paper and rotates in the direction away from the first side passage plate during paper pullout.

Further, the paper jam detection plate is adjacent with the paper pullout detection plate, and the adjacent ends of the two are arranged crosswise to form a smooth paper conveying surface.

Further, several paper supporters are arranged in the direction of the width of the paper on the surface of the paper jam detection plate facing the paper and on the surface of the paper pullout detection plate facing the paper.

Further, the paper jam detection plate is located at an inlet side of the S-shaped paper conveying passage and the paper pullout detection plate is located at an outlet side of the S-shaped paper conveying passage.

Further, two sides of the first side passage along the direction of the width of the paper are detachably engaged on the frame.

Further, the pivoting axis of the paper jam detection plate is located on one side of the paper jam detection plate close to the paper pullout detection plate, and the pivoting axis of the paper pullout detection plate is located on one side of the paper pullout detection plate close to the paper jam detection plate.

Further, along the paper conveying direction, the pivoting axis of the paper jam detection plate is located in the downstream of the pivoting axis of the paper pullout detection plate, and the paper jam detection plate is provided with pivotal connection arms extending at two sides of the paper pullout detection plate along the direction of the width of paper.

Further, one side of the paper jam detection plate back to the paper conveying passage is provided with a first detected portion and the frame is provided with a first detection component detecting a set position of the first detected portion; one side of the paper pullout detection plate back to the paper conveying passage is provided with a second detected portion, and the frame is provided with a second detection component detecting a set position of the second detected portion.

Further, the first side passage plate and/or the second side passage plate are/is provided with a spacing location mechanism for maintaining a preset spacing distance between the first side passage plate and the second side passage plate.

A printing device is provided according to another aspect of the present invention, comprising a printing assembly, a cutter assembly and the paper discharge mechanism described above arranged along a paper conveying direction in turn.

The present invention provides a terminal equipment which is provided with the printing device described above.

In the paper discharge mechanism of the present invention, whether paper is blocked during a conveying process is determined through the position of the paper jam detection plate so as to send alarm indication or cut off the paper in time and prevent the paper from being blocked in the paper conveying passage; whether the paper is pulled during the conveying process is determined through the position of the paper pullout detection plate so as to send alarm indication or cut off the paper when the paper is pulled and prevent a user from pulling the paper. Therefore, a device fault can be avoided by preventing the user from stopping paper conveying or pulling paper. At the same time, both outside disposed paper and inside disposed paper can move smoothly in the S-shaped paper conveying passage. The paper discharge mechanism of the present invention is capable of preventing a user from interfering with paper output and also enhancing the reliability of paper conveyance.

Besides the purpose, features and advantages descried above, the present invention has other purposes, features and advantages, and these purposes, features and advantages will be described in details in combination with the accompanying drawings.

BRIEF DESCRIPTION OF THE DRAWINGS

The accompanying drawings, which constitute a part of the specification and are used for further understanding the present invention, illustrate preferred embodiments of the present invention and are used for describing the principle of the present invention together with the specification. In the drawings.

REFERENCE NUMERALS

Figure 1:
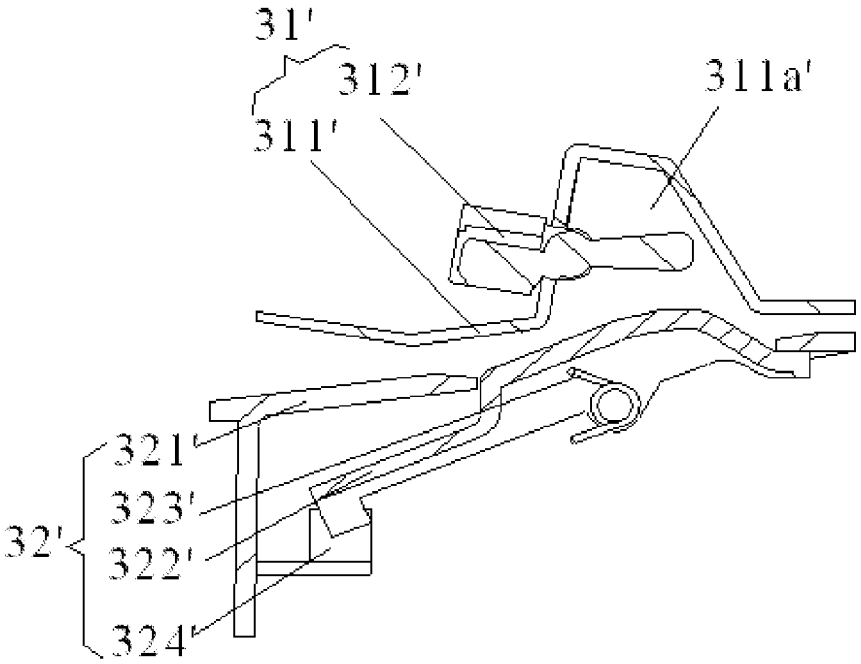
Fig. 1 Prior Art
FIG. 1 is a structural diagram of a paper discharge mechanism in the prior art.
Figure 2A:
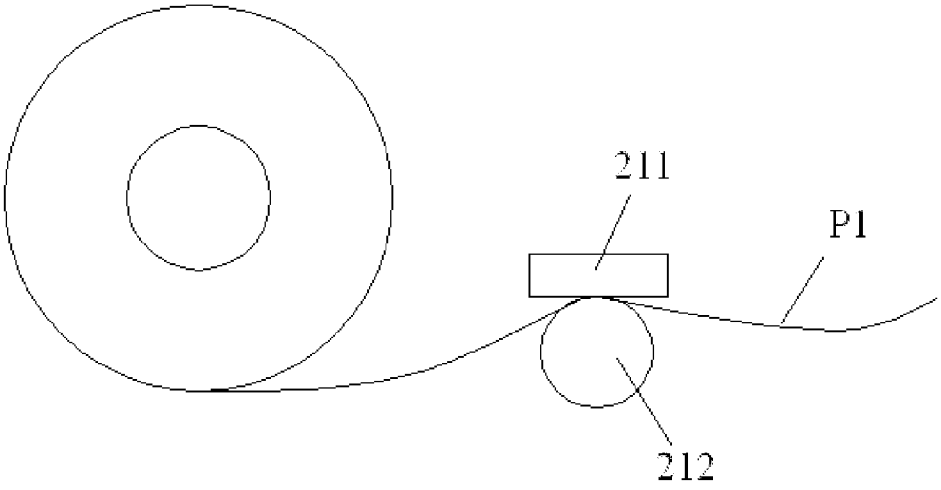
FIG. 2*a* is a schematic diagram illustrating a curled state during printing process of an inside disposed paper.
Figure 2B:
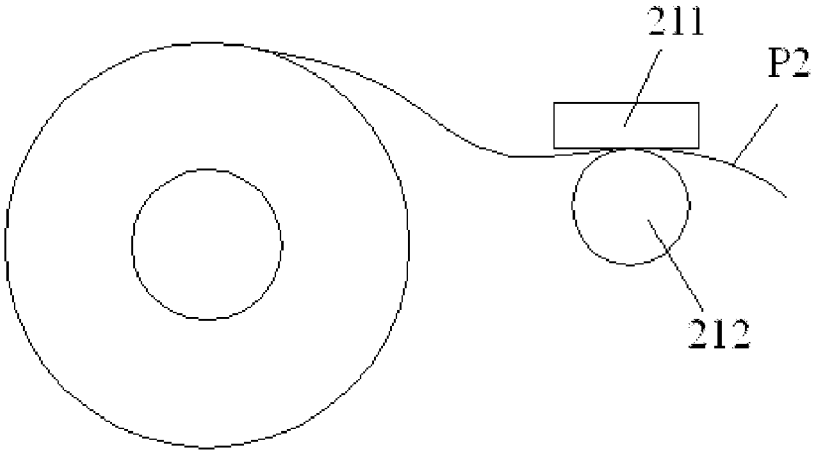
FIG. 2*b* is a schematic diagram illustrating a curled state during printing process of an outside disposed paper.

1 terminal main body
2 printing device
3 paper discharge mechanism
20 first paper exit
10 second paper exit
30 frame
31 paper pullout detection assembly
311 paper pullout detection plate
312 elastic element
313 rotating axis
314 sensor
311*a* protruding portion
32 paper jam detection assembly
321 paper jam detection plate
322 elastic element
323 rotating axis
324 sensor
321*a* protruding portion
331 elastic claw
332 supporting shaft
311*b* locating portion
321*b* locating portion
33 fixed passage plate
301 mounting hole
302 mounting hole
303 locating hole
304 open groove
305 mounting groove
306 locating hole
21 printing assembly
22 paper cutting assembly
23 paper roll supporting assembly
211 thermal printing head
212 roller
221 fixed blade
222 movable blade

DETAILED DESCRIPTION OF THE INVENTION

Embodiments of the present invention will be described in details hereinafter in combination with the accompanying drawings. However, the present invention may be implemented by various different methods limited and covered by the claims.

Figure 3:
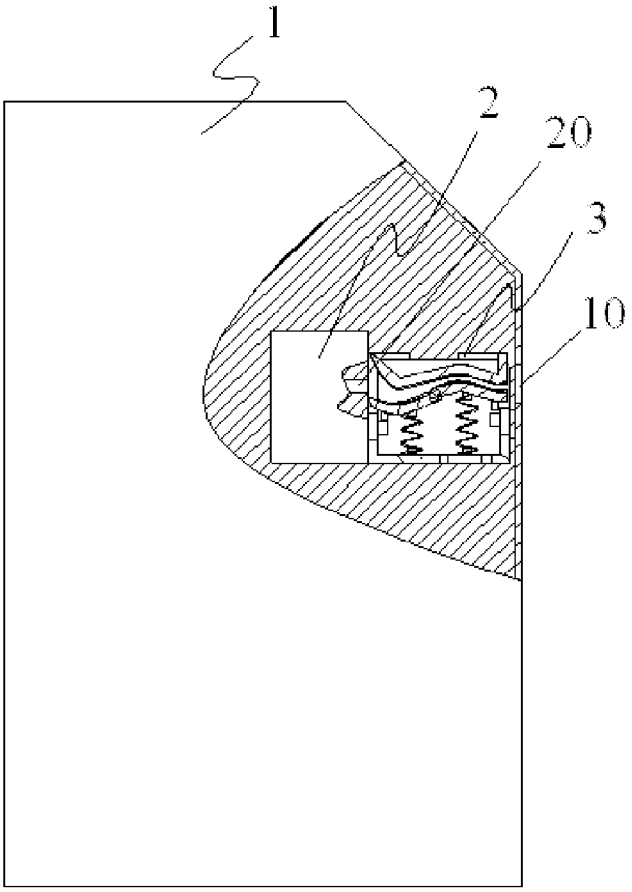
FIG. 3 is a schematic diagram illustrating an embodiment of a terminal equipment according to the present invention.

FIG. 3 is a schematic diagram illustrating the first embodiment of a terminal equipment according to the present invention. As shown in FIG. 3, the terminal equipment comprises a terminal main body 1, a printing device 2 and a paper discharge mechanism 3. The printing device 2 is set in the terminal main body 1 and the printing device 2 is provided with a first paper exit 20 configured to output printed paper from the printing device; the terminal main body 1 is provided with a second paper exit 10 configured to discharge paper out of the terminal main body 1; the paper discharge mechanism 3 is located between the first paper exit 20 and the second paper exit 10 and configured to connect the first paper exit 20 and the second paper exit 10 to form a paper conveying passage for conveying paper.

The terminal equipment may be a self-service terminal equipment comprising an ATM, a self-service telephone bill enquiry machine etc., and a device comprising a Point Of Sales (POS) printer, a tax-controlled cash register and a lottery machine etc.

Figure 4:
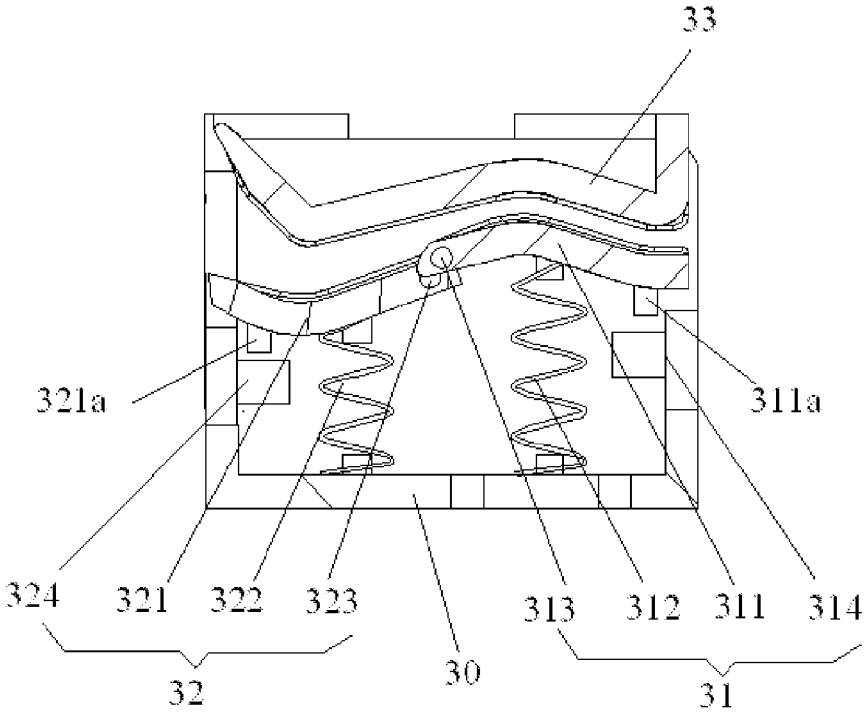
FIG. 4 is a sectional view of the first embodiment of a paper discharge mechanism according to the present invention.

FIG. 4 is a sectional view of the first embodiment of a paper discharge mechanism according to the present invention. As shown in FIG. 4, the paper discharge mechanism 3 comprises a paper pullout detection assembly 31 and a paper jam detection assembly 32.

The paper discharge mechanism 3 comprises a frame 30, the paper pullout detection mechanism 31, the paper jam detection assembly 32 and a fixed passage plate (i.e. a first side passage plate) 33.

The fixed passage plate 33 is mounted on the frame 30, supported by the frame 30 and located on one side of the paper conveying passage.

The paper pullout detection assembly 31 comprises a paper pullout detection plate 311, an elastic element 312, a rotating axis 313 and a sensor 314. The paper pullout detection plate 311 is opposite to the fixed passage plate 33 and located on the other side of the paper conveying passage. One end of the paper pullout detection plate 311 is pivotally connected with the frame 30 through the rotating axis 313 and the other end of the paper pullout detection plate 311 is suspended. The paper pullout detection plate 311 can rotate around the rotating axis 313.

The elastic element 312 is located between the paper pullout detection plate 311 and the frame 30, and one end of the elastic element 312 is connected with the paper pullout detection plate 311 and the other end is connected with the frame 30. The elasticity of the elastic element 312 enables the paper pullout detection plate 311 to always have the trend of rotating toward the direction close to the fixed passage plate 33.

A locating portion (not shown in the figure) of the paper pullout detection plate 311 is connected with the frame 30 to limit the maximum rotating angle of the paper pullout detection plate 311 toward the fixed passage plate 33. Therefore, the paper pullout detection plate 311 is capable of maintaining a set distance with the fixed passage plate 33 so as to enable paper to pass therebetween.

The sensor 314 is fixedly connected with the frame 30 and configured to detect the position of the paper pullout detection plate 311. A position of the paper pullout detection plate 311 corresponding to the sensor 314 is provided with a protruding portion (i.e. a first detected portion) 311*a* corresponding to a detection portion of the sensor 314. Rotating with the paper pullout detection plate 311, the protruding portion 311*a* can be matched with or separated from the detection portion of the sensor 314. When the protruding portion 311*a* of the paper pullout detection plate 311 is matched with the detection portion of the sensor 314, the sensor 314 detects the paper pullout detection plate 311. When the protruding portion 311*a* of the paper pullout detection plate 311 is separated from the detection portion of the sensor 314, the sensor 314 fails to detect the paper pullout detection plate 311.

In the present invention, it is set that when the sensor 314 fails to detect the paper pullout detection plate 311, the paper pullout detection plate 311 is located at a normal position; otherwise, the paper pullout detection plate 311 is located at an abnormal position. Of course, in other embodiments of the present invention, it can be set that when the sensor 314 detects the paper pullout detection plate 311, the paper pullout detection plate 311 is located at a normal position; otherwise, the paper pullout detection plate 311 is located at an abnormal position.

The sensor 314 may be a photoelectric sensor, a micro-switch or a cantilever mechanical sensor etc. When the sensor 314 is a photoelectric sensor, the detection portion of the sensor 314 is an optical emitter and an optical receiver set oppositely at an interval.

When the paper pullout detection plate 311 is located at a normal position, the optical receiver fully receives light rays emitted by the optical emitter, and the sensor outputs a first detection value, e.g. a high voltage. When the paper pullout detection plate 311 is located at an abnormal position, the protruding portion 311*a* of the paper pullout detection plate 311 is located between the optical emitter and the optical receiver to block a light transmission path between the optical emitter and the optical receiver so that the optical receiver fails to receive light rays, and the sensor 314 outputs a second detection value, e.g. a low voltage. Therefore, whether the paper pullout detection plate 311 is located at a normal position or an abnormal position can be determined according to a detection value outputted by the sensor 314.

The paper jam detection assembly 32 comprises a paper jam detection plate 321, an elastic element 322, a rotating axis 323 and a sensor 324.

The paper jam detection plate 321 and the paper pullout detection plate 311 are located on the same side of the paper conveying passage and opposite to the fixed passage plate 33. The paper jam detection plate 321 and the paper pullout detection plate 311 are combined to form a second side passage plate.

One end of the paper jam detection plate 321 is hinged with the frame 30 through the rotating axis 323 and the other end is suspended. The paper jam detection plate 321 can rotate around the rotating axis 323. The elastic element 322 is located between the paper jam detection plate 321 and the frame 30. One end of the elastic element 322 is connected with the paper jam detection plate 321 and the other end is connected with the frame 30. The elasticity of the elastic element 322 enables the paper jam detection plate 321 to always have the trend of rotating toward the direction close to the fixed passage plate 33. A locating portion (not shown in the figure) of the paper jam detection plate 321 is connected with the frame 30 to limit the maximum rotating angle of the paper jam detection plate 321 toward the fixed passage plate 33. Therefore, the paper jam detection plate 321 can maintain a set distance with the fixed passage plate 33 so as to enable paper to pass therebetween.

The sensor 324 is fixedly connected with a frame of the paper jam detection assembly and configured to detect the position of the paper jam detection plate 321. The sensor 324 may be a photoelectric sensor, a micro-switch or a cantilever mechanical sensor etc. A position of the paper jam detection plate 321 corresponding to the sensor 324 is provided with a protruding portion (i.e. a second detected portion) 321*a*.

Rotating with the paper jam detection plate 321, the protruding portion 321*a* can be matched with or separated from a detection portion of the sensor 324.

When the protruding portion 321*a* of the paper jam detection plate 321 is matched with the detection portion of the sensor 324, the sensor 324 detects the paper jam detection plate 321. When the protruding portion 321*a* of the paper jam detection plate 321 is separated from the detection portion of the sensor 324, the sensor 324 fails to detect the paper jam detection plate 321.

In the present embodiment, it is set that when the sensor 324 fails to detect the paper jam detection plate 321, the paper jam detection plate 321 is located at a normal position; otherwise, the paper jam detection plate 321 is located at an abnormal position. Of course, in other embodiments of the present invention, it can be set that when the sensor 324 detects the paper jam detection plate 321, the paper jam detection plate 321 is located at a normal position; otherwise, the paper jam detection plate 321 is located at an abnormal position.

The sensor 324 may be a photoelectric sensor, a microswitch or a cantilever mechanical sensor etc. When the sensor 324 is a photoelectric sensor, the detection portion of the sensor 324 is an optical emitter and an optical receiver set oppositely at an interval. When the paper jam detection plate 321 is located at a normal position, the optical receiver fully receives light rays emitted by the optical emitter, and the sensor outputs a third detection value, e.g. a high voltage. When the paper jam detection plate 321 is located at an abnormal position, the protruding portion 321*a* of the paper jam detection plate 321 is located between the optical emitter and the optical receiver to block a light transmission path between the optical emitter and the optical receiver so that the optical receiver fails to receive light rays, and the sensor 324 outputs a fourth detection value, e.g. a low voltage. Therefore, whether the paper jam detection plate 321 is located at a normal position or an abnormal position can be determined according to a detection value outputted by the sensor 324.

An S-shaped paper conveying passage is formed between the first side passage plate and the second side passage plate, i.e. the fixed passage plate 33 is opposite to the paper pullout detection plate 311 and the paper jam detection plate 321 to form the S-shaped paper conveying passage. The paper pullout detection plate 311 and the paper jam detection plate 321 are connected crosswise in a smooth manner. The contact surfaces of the paper pullout detection plate 311 and the paper jam detection plate 321 with paper are S-shaped, wherein the surface of the paper pullout detection plate 311 facing paper is convex. When paper is pulled, the paper pullout detection plate 311 is held against the paper and deflects toward the direction away from the fixed passage plate 33. The surface of the paper jam detection plate 321 facing paper is concave. When paper is blocked, the paper jam detection plate 321 is held against the paper and deflects in the direction away from the fixed passage plate 33.

The working principle of the paper discharge mechanism is briefly summarized as follows:

if an operator pulls paper conveyed in the paper discharge mechanism, the paper straightened by the pull squeezes the paper pullout detection plate 311 located at a convex portion of the S-shaped paper conveying passage; the paper pullout detection plate 311 overcomes the elasticity of the elastic element 312 to rotate toward the direction away from the fixed passage plate 33; when detecting that the paper pullout detection plate 311 is located at an abnormal position, the sensor 314 outputs a signal indicating that the paper pullout detection plate 311 is abnormal, thus avoiding a fault caused by paper pullout performed by the operator;

if an operator blocks a paper exit P and stops paper output, blocked paper is stacked at the paper jam detection plate 321 located at a concave portion of the S-shaped paper conveying passage; the stacked paper pushes the paper jam detection plate 321 to overcome the elasticity of the elastic element 322 to rotate around the rotating axis 323 toward the direction away from the fixed passage plate 33; when detecting that the paper jam detection plate 321 is located at an abnormal position, the sensor 324 outputs a signal indicating that the paper jam detection plate 321 is abnormal, thus avoiding a fault because of paper jam caused by the operator.

At the same time, since the fixed passage plate is opposite to the paper pullout detection plate and the paper jam detection plate to form the S-shaped paper conveying passage which is smooth with no opening, both outside disposed paper and inside disposed paper can be conveyed smoothly in the S-shaped paper conveying passage.

Therefore, the paper discharge mechanism according to the present invention is capable of preventing a user from interfering with paper output and also enhancing the reliability of paper conveyance.

Figure 5:
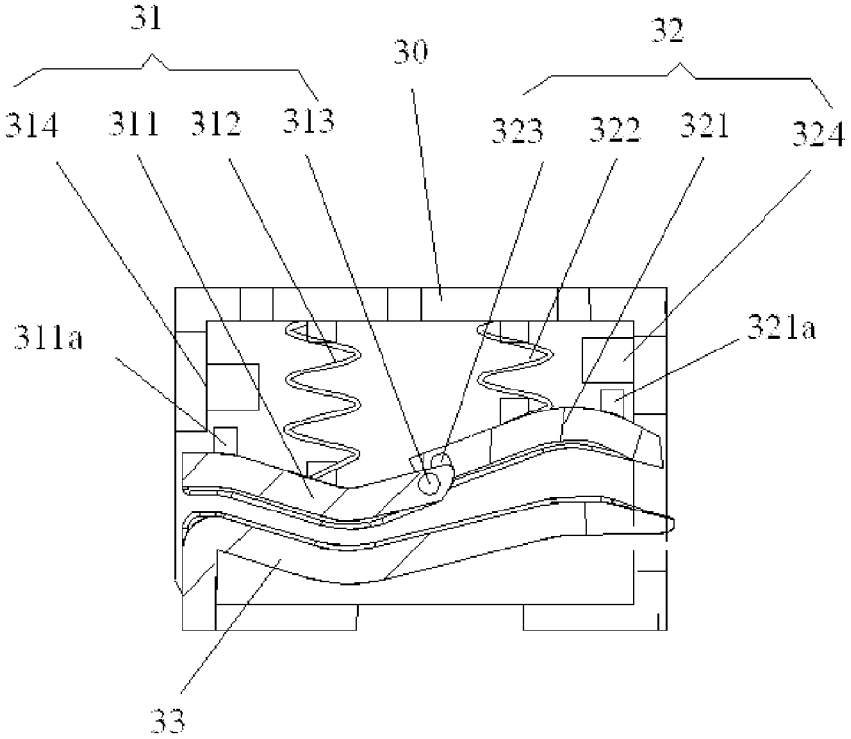
FIG. 5 is a sectional view of the second embodiment of a paper discharge mechanism according to the present invention.

FIG. 5 is a sectional view of the second embodiment of a paper discharge mechanism according to the present invention. The present embodiment is different from the first embodiment of the present invention in that a fixed passage plate 33 is located at a lower side of an S-shaped paper conveying passage, and along the paper conveying direction, a paper jam detection plate 321 is located in the downstream of a paper pullout detection plate 311.

Figure 6:
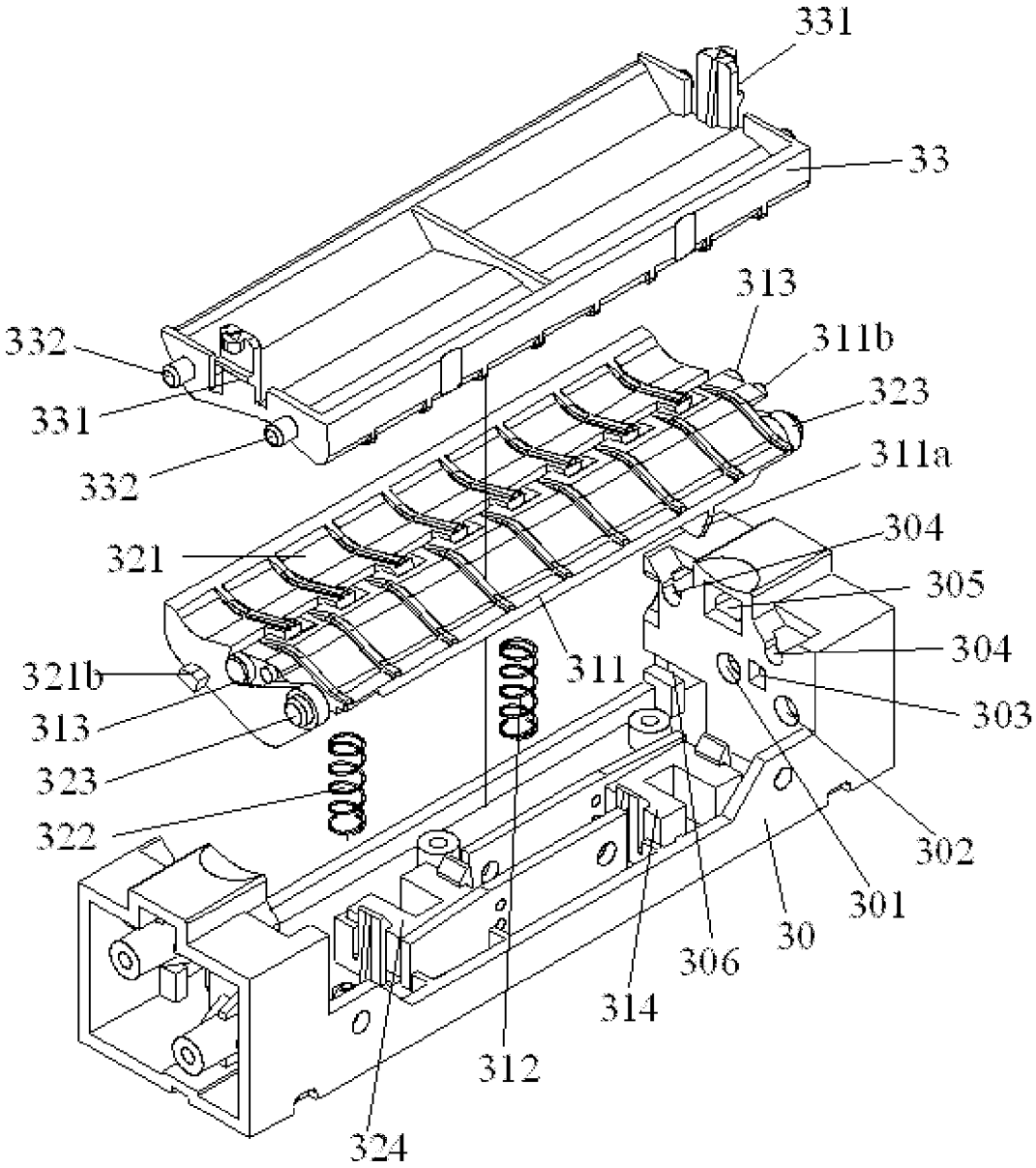
FIG. 6 is an exploded view of the third embodiment of a paper discharge mechanism according to the present invention.

FIG. 6 is an exploded view of the third embodiment of a paper discharge mechanism according to the present invention. The present embodiment is different from the first embodiment of the present invention in that the pivotal connection position of a paper jam detection plate 321 of a paper jam detection assembly and a frame 30 is different from that in the embodiments above, wherein in the embodiments above, the position of the pivoting axis of the paper jam detection plate 321 pivoting relative to the frame 30 is close to the position of the pivoting axis of the paper pullout detection plate 311 pivoting relative to the frame 30. In the present embodiment, a pivotal connection arm of the paper jam detection plate 321 extends at two sides of a paper pullout detection plate along the direction of the width of paper, and the pivoting axis of the paper jam detection plate pivoting relative to the frame 30 is located away from the pivoting axis of the paper pullout detection plate 311 pivoting relative to the frame 30.

A specific implementation mode of connection relations of parts of the paper discharge mechanism in the present embodiment will be described as follows in combination with FIG. 6.

A fixed passage plate 33 is detachably connected with the frame 30 through elastic claws 331. When the elastic claws 331 provided at two sides of the fixed passage plate 33 are engaged with mounting grooves 305 provided at two sides of the frame 30, supporting shafts 332 provided at the two sides of the fixed passage plate 33 are engaged with open grooves 304 provided at the two sides of the frame 30, and the fixed passage plate 33 is fixedly connected with the frame 30. When an operator extrudes the elastic claws 331 so that they are separated from the mounting grooves 305 of the frame, the fixed passage plate 33 can be separated from the frame 30.

In a paper pullout detection assembly 31, a rotating axis 313 is fixedly connected with two sides of the paper pullout detection plate 311, and the rotating axis 313 is inserted into mounting holes 301 provided at two side walls of the frame 30 so that the paper pullout detection plate 311 is pivotally connected with the frame 30 and capable of rotating around the rotating axis 313.

An elastic element 312 is located between the paper pullout detection plate 311 and the frame 30. The elasticity of the elastic element 312 enables the paper pullout detection plate 311 to always have the trend of rotating toward the direction close to the fixed passage plate 33. Locating portions 311*b* of the paper pullout detection plate 311 are inserted into locating holes 303 provided at the two side walls of the frame 30 to limit a rotating angle of the paper pullout detection plate 311 toward the fixed passage plate 33. Therefore, the paper pullout detection plate 311 can maintain a set distance with the fixed passage plate 33. A sensor 314 is fixedly connected with the frame 30. A protruding portion 311*a* of the paper pullout detection plate 311 corresponds to a detection portion of the sensor 314. Rotating with the paper pullout detection plate 311, the protruding portion 311*a* can be matched with or separated from the detection portion of the sensor 314.

In a paper jam detection assembly 32, a rotating axis 323 is fixedly connected with two sides of the paper jam detection plate 321. The rotating axis 323 is inserted into mounting holes 302 provided at the two side walls of the frame 30 so that the paper jam detection plate 321 is pivotally connected with the frame 30 and is capable of rotating around the rotating axis 323.

An elastic element 322 is located between the paper jam detection plate 321 and the frame 30. The elasticity of the elastic element 322 enables the paper jam detection plate 321 to always have the trend of rotating toward the direction close to the fixed passage plate 33. Locating portions 321*b* of the paper jam detection plate 321 are engaged with locating holes 306 provided at the two sides of the frame 30 to limit a rotating angle of the paper jam detection plate 321 toward the fixed passage plate 33. Therefore, the paper jam detection plate 321 can maintain a set distance with the fixed passage plate 33. A sensor 324 is fixedly connected with the frame 30. A protruding portion (not shown in the figure) of the paper jam detection plate 321 corresponds to a detection portion of the sensor 324. Rotating with the paper jam detection plate 321, the protruding portion of the paper jam detection plate 321 can be matched with or separated from the detection portion of the sensor 324.

One end of the paper pullout detection plate 311 of the paper pullout detection assembly 31 is provided with a plurality of grooves at intervals along the direction of the width of paper. One end of the paper jam detection plate 321 of the paper jam detection assembly 32 matched with the paper pullout detection plate 311 is provided with a plurality of extending portions along the direction of the width of paper. The extending portions of the paper jam detection plate 321 are inserted into grooves of the paper pullout detection plate 311. Therefore, the paper pullout detection plate 311 is connected smoothly with the paper jam detection plate 321, thus effectively avoiding jam at the matched position of the paper pullout detection plate 311 and the paper jam detection plate 321. Paper conveying surfaces of the paper pullout detection plate 311 and the paper jam detection plate 321 in contact with paper are S-shaped, wherein the paper pullout detection plate 311 is located at a convex portion of the S shape, and the paper jam detection plate 321 is located at a concave portion of the S shape.

The present embodiment has the same working principle with that of the embodiments above, and will not be described repeatedly here.

Figure 7A:
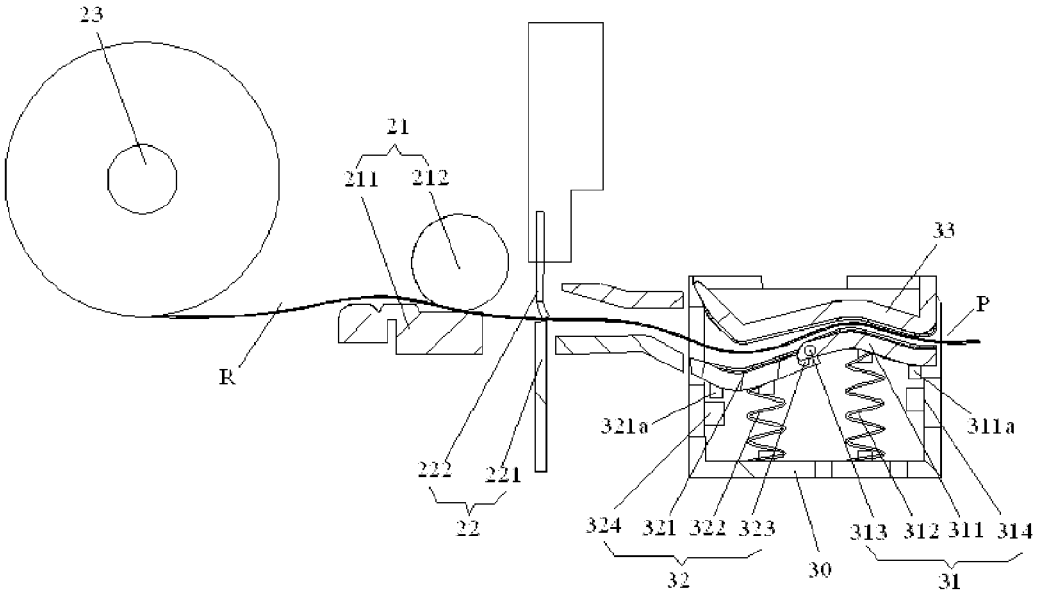
FIG. 7*a* is a schematic diagram illustrating a printing device of the paper discharge mechanism as shown in FIG. 4 in the case of normal paper conveying.
Figure 7B:
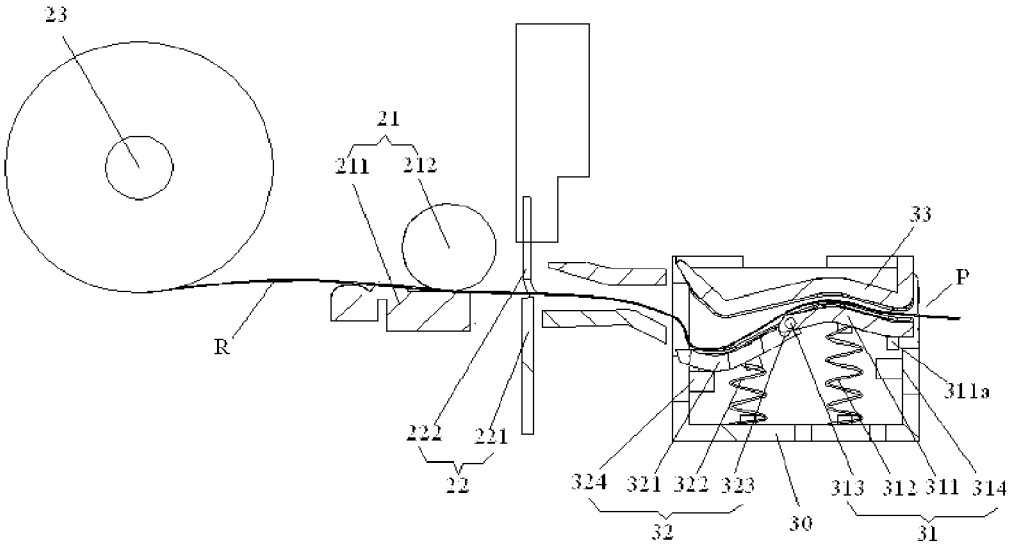
FIG. 7*b* is a schematic diagram illustrating a printing device of the paper discharge mechanism as shown in FIG. 4 in the case of paper jam.
Figure 7C:
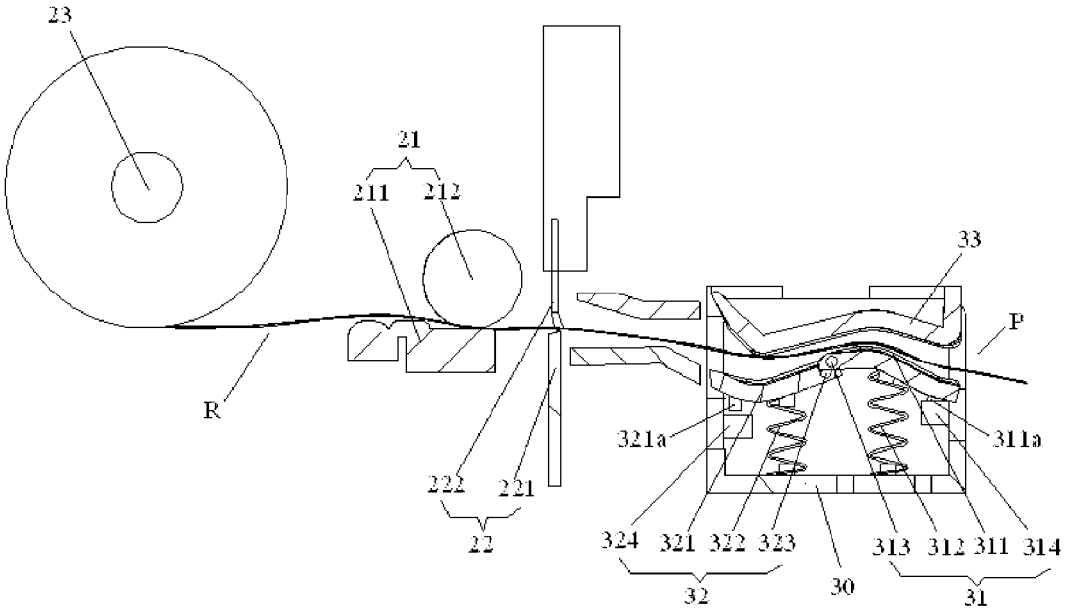
FIG. 7*c* is a schematic diagram illustrating a printing device of the paper discharge mechanism as shown in FIG. 4 in the case of paper pullout.

FIG. 7*a* is a schematic diagram illustrating a printing device of the paper discharge mechanism as shown in FIG. 4 in the case of normal paper conveying, FIG. 7*b* is a schematic diagram illustrating a printing device of the paper discharge mechanism as shown in FIG. 4 in the case of paper jam; and FIG. 7*c* is a schematic diagram illustrating a printing device of the paper discharge mechanism as shown in FIG. 4 in the case of paper pullout.

As shown in FIG. 7*a*, a printing device 2 comprises a printing assembly 21, a paper cutting assembly 22 and a paper roll supporting assembly 23. The paper roll supporting assembly 23 is configured to support a paper roll used for printing. The printing assembly 21 is located in the downstream of the paper roll supporting assembly 23 and configured to print an image or a text on paper R. In the present embodiment, the printing assembly 21 is a thermal printing assembly comprising a thermal printing head 211 and a roller 212 set oppositely at two sides of a passage. In a printing process, paper R passes between the thermal printing head 211 and the roller 212. The roller 212, while supporting the paper to match the thermal printing head 211, drives the paper to move to the downstream of the printing assembly 21 so that the thermal printing head 211 can print images or texts continuously on the paper.

In other embodiments of the present invention, the printing assembly 21 may be also of a needle type, an ink-jetting type or a laser type etc. The paper cutting assembly 22 is located in the downstream of the printing assembly 21 and comprises a fixed blade 221 and a moveable blade 222 set oppositely. Paper R passes between the fixed blade 221 and the moveable blade 222. The moveable blade 222 and the fixed blade 221 reciprocate in a straight line to cut off the paper so that the paper is separated from the paper roll.

The working principle of a printing device using a paper discharge mechanism of the present invention will be described as follows in combination with FIG. 7*a*, FIG. 7*b* and FIG. 7*c*.

As shown in FIG. 7*a*, when the printing device works normally, paper is guided out from the paper roll supporting assembly 23 to pass through the printing assembly 21, the paper cutting assembly 22 and the paper discharge mechanism 3 in turn, and discharged from the paper exit P. In a paper conveying process, the printing assembly prints an image or a text on the paper. After printing, the paper cutting assembly cuts the paper, and the printed paper is separated from the paper roll. In this process, the paper pullout detection plate 311 of the paper pullout detection assembly and the paper jam detection plate 321 of the paper jam detection assembly are located at normal positions.

As shown in FIG. 7*b*, when paper is blocked during the paper conveying process, the blocked paper is stacked and bent at the concave portion (i.e. the paper jam detection plate 321) of the S-shaped paper conveying passage. The bent paper overcomes the elasticity of the elastic element 324 to push the paper jam detection plate 321 to rotate around the rotating axis 323 toward the direction away from the fixed passage plate 33 so that the protruding portion 321*a* of the paper jam detection plate 321 is matched with the detection portion of the sensor 324. The sensor 324 outputs a second detection signal. Therefore, when detecting the second detection signal outputted by the sensor 324, a controller of the printing device sends out paper jam alarm indication and/or cuts off the paper. When hearing a paper jam alarm, an operator pulls out the paper in time so as to avoid a paper jam fault.

As shown in FIG. 7*c*, when paper is pulled during the paper conveying process, the loosened paper is tightened, and the tightened paper squeezes the convex portion (i.e. the paper pulled out detection plate 311) of the S-shaped paper conveying passage to force the paper pulled out detection plate 311 to rotate around the rotating axis 313 toward the direction away from the fixed passage plate 33. The protruding portion 321*a* of the paper pullout detection plate 311 is matched with the detection portion of the sensor 314, and the sensor 314 outputs a fourth detection signal. Therefore, when detecting the fourth detection signal outputted by the sensor 314, the controller of the printing device controls the paper cutting assembly 22 of the printing device 2 to cut off the paper, thus preventing the operator from pulling the paper and causing a paper jam fault or waste of paper.

The above are only preferred embodiments of the present invention and should not be used for limiting the present invention. For those skilled in the art, the present invention may have various modifications and changes. Any modifications, equivalent replacements, improvements and the like within the spirit and principle of the present invention shall fall within the scope of protection of the present invention.

The invention claimed is:

1. A paper discharge mechanism, wherein it comprises:

a first side passage plate and a second side passage plate between which an S-shaped paper conveying passage is formed, wherein the second side passage plate comprises a paper jam detection plate and a paper pullout detection plate which are both pivotally connected on a frame;

a first elastic element biasing the paper jam detection plate toward the first side passage plate and a second elastic element biasing the paper pullout detection plate toward the first side passage plate; and a first sensor for detecting the position of the paper jam detection plate and a second sensor for detecting the position of the paper pullout detection plate, wherein a surface of the paper jam detection plate facing paper is concave and is held against the paper and rotates in the direction away from the first side passage plate during paper jam; a surface of the paper pullout detection plate facing the paper is convex and is held against the paper and rotates in the direction away from the first side passage plate during paper pullout.

2. The paper discharge mechanism according to claim 1, wherein the paper jam detection plate is adjacent to the paper pullout detection plate, and the adjacent ends of the both are arranged crosswise to each other to form a smooth paper conveying surface.

3. A printing device, wherein it comprises a printing assembly, a cutter assembly and the paper outputting mechanism according to claim 2 arranged along a paper conveying direction in turn.

4. The paper discharge mechanism according to claim 1, wherein the paper jam detection plate is located at an inlet side of the S-shaped paper conveying passage and the paper pullout detection plate is located at an outlet side of the S-shaped paper conveying passage.

5. A printing device, wherein it comprises a printing assembly, a cutter assembly and the paper outputting mechanism according to claim 4 arranged along a paper conveying direction in turn.

6. The paper discharge mechanism according to claim 1, wherein two sides of the first side passage along the direction of the width of the paper are detachably engaged on the frame.

7. A printing device, wherein it comprises a printing assembly, a cutter assembly and the paper outputting mechanism according to claim 6 arranged along a paper conveying direction in turn.

8. The paper discharge mechanism according to claim 1, wherein a pivoting axis of the paper jam detection plate is located on one side of the paper jam detection plate close to the paper pullout detection plate, and a pivoting axis of the paper pullout detection plate is located on one side of the paper pullout detection plate close to the paper jam detection plate.

9. A printing device, wherein it comprises a printing assembly, a cutter assembly and the paper outputting mechanism according to claim 8 arranged along a paper conveying direction in turn.

10. The paper discharge mechanism according to claim 1, wherein along the paper conveying direction, a pivoting axis of the paper jam detection plate is located in the downstream of a pivoting axis of the paper pullout detection plate, and the paper jam detection plate is provided with pivotal connection arms extending at two sides of the paper pullout detection plate along the direction of the width of paper.

11. A printing device, wherein it comprises a printing assembly, a cutter assembly and the paper outputting mechanism according to claim 10 arranged along a paper conveying direction in turn.

12. The paper discharge mechanism according to claim 1, wherein one side of the paper jam detection plate back to the paper conveying passage is provided with a first detected portion and the frame is provided with a first detection component detecting a set position of the first detected portion; one side of the paper pullout detection plate back to the paper conveying passage is provided with a second detected portion, and the frame is provided with a second detection component detecting a set position of the second detected portion.

13. A printing device, wherein it comprises a printing assembly, a cutter assembly and the paper outputting mechanism according to claim 12 arranged along a paper conveying direction in turn.

14. The paper discharge mechanism according to claim 1, wherein the first side passage plate and/or the second side passage plate are/is provided with a spacing location mechanism for maintaining a preset spacing distance between the first side passage plate and the second side passage plate.

15. A printing device, wherein it comprises a printing assembly, a cutter assembly and the paper outputting mechanism according to claim 14 arranged along a paper conveying direction in turn.

16. A printing device, wherein it comprises a printing assembly, a cutter assembly and the paper discharge mechanism according to claim 1 arranged along a paper conveying direction in turn.

17. A terminal equipment, wherein it is provided with the printing device according to claim 16.

* * * * *